US007743780B1

(12) United States Patent
Eggan

(10) Patent No.: US 7,743,780 B1
(45) Date of Patent: Jun. 29, 2010

(54) WALKER GLIDE

(76) Inventor: David J. Eggan, 31 Union Church Rd., Tylertown, MS (US) 39667

( * ) Notice: Subject to any disclaimer, the term of this patent is extended or adjusted under 35 U.S.C. 154(b) by 0 days.

(21) Appl. No.: 12/453,316

(22) Filed: May 6, 2009

(51) Int. Cl.
*A61H 3/00* (2006.01)
*A45B 9/04* (2006.01)
*A45B 3/00* (2006.01)

(52) U.S. Cl. ..... 135/67; 137/77; 137/66

(58) Field of Classification Search ..... 135/67, 135/77, 78, 79, 86, 85; 16/42 T
See application file for complete search history.

(56) References Cited

U.S. PATENT DOCUMENTS

| | | | | |
|---|---|---|---|---|
| 1,898,309 | A | 2/1933 | Noelting | |
| 4,094,330 | A | 6/1978 | Jong | |
| 4,784,386 | A * | 11/1988 | Muehl | 482/122 |
| 5,001,808 | A | 3/1991 | Chung | |
| 5,353,825 | A | 10/1994 | Davis | |
| 5,485,862 | A * | 1/1996 | Kahn | 135/77 |
| 6,508,732 | B1 | 1/2003 | Romberger et al. | |
| D580,205 | S | 11/2008 | Callahan | |
| 2003/0226585 | A1 | 12/2003 | Burchel | |
| 2005/0205122 | A1 | 9/2005 | Bly et al. | |
| 2006/0053587 | A1 * | 3/2006 | Chase | 16/42 R |
| 2007/0102080 | A1 | 5/2007 | Spangler | |
| 2009/0056778 | A1 | 3/2009 | Dean | |
| 2009/0078296 | A1 | 3/2009 | Diamond | |

OTHER PUBLICATIONS

Website, http://www.allegromedical.com//walkers-c516/drive-tennis-balls-glides-p554770.html?engine=shopzilla&utm_source=shopzilla&utm_medium=feed&CS_003=9076286&CS_010=ff808081129a97c601129c60c23c0499, Drive Tennis Ball Glides, three sheets printed from the internet on Apr. 2, 2009.
Website, http://precuttennisballs.com/index.html, Precut Tennis Balls, three sheets printed from the internet on Apr. 2, 2009.

* cited by examiner

*Primary Examiner*—David Dunn
*Assistant Examiner*—Danielle Jackson
(74) *Attorney, Agent, or Firm*—Richard C. Litman

(57) ABSTRACT

The walker glide is a spherical attachment for removable installation over the lower end of a walker leg or other legged article. The glide is formed of a hollow, resilient ball and includes a plurality of leg attachment holes therethrough. No two holes are aligned directly and diametrically opposite one another. Any hole always has an unbroken ball surface directly diametrically across therefrom. This allows any given hole of the ball to be placed over the end of the leg, while assuring that the leg tip will bear against the opposite unbroken surface of the ball. When the bearing surface of the ball becomes worn, the user need only remove the ball and reorient it by installing it on the leg using another hole to provide a fresh bearing surface for the ball. While any suitable type of ball may be used, tennis balls have been found to work well.

9 Claims, 4 Drawing Sheets

WALKER GLIDE

BACKGROUND OF THE INVENTION

1. Field of the Invention

The present invention relates generally to ambulatory aids and the like, and more particularly to a walker glide in the form of a resilient ball provided with a plurality of holes for installing over the lower end of a walker leg. The ball is repositioned to expose a fresh surface beneath the end of the walker leg whenever the bottom surface of the ball becomes worn.

2. Description of the Related Art

Walkers, canes, crutches, and the like are conventionally used to assist the walking of persons who have physical difficulty in ambulation for whatever reason, i.e., illness, injury, etc. While some persons may be able to get by using only a cane, or perhaps a pair of crutches, others require the additional support and stability provided by a walker. Such walkers conventionally have four legs extending downwardly from a generally rectangular frame, with the user supporting him or herself upon the frame and progressively shifting the walker forward with each step. In many cases the walker is equipped with rollers or wheels on the two forward legs, with a fixed tip (crutch tip, etc.) on the two rearward legs. Other walkers are equipped with fixed tips on all four legs. The technique of use generally results in a fair amount of sliding and shuffling of the walker over the surface, particularly with the rear legs, thus scraping the lower ends of the legs over the surface.

Accordingly, such walkers are conventionally equipped with some form of resilient pad on the bottom end of each leg to avoid marring the floor and to reduce noise. It has been found by many users of such walkers that the relatively small diameter crutch tip type of pad with its relatively sharp lower edge and flat bottom is prone to catching upon various articles resting upon the floor, such as electrical cords, the edges of rugs, etc. Also, the rubber material of which such tips are formed generally results in a relatively high coefficient of friction between the walker and the underlying surface, thus making it difficult for the user of the walker to shuffle or slide the walker across the surface.

As a result, many users of such devices install tennis balls or some other type of ball of about the same size upon the lower ends of the non-roller or non-wheel walker legs. The larger diameter of the tennis ball passes over such potential obstacles as electrical cords and the edges of rugs and the like, without catching or snagging upon them. Tennis balls or the like also provide somewhat less friction when weight is applied to the walker, thus allowing the user to slide the walker over the surface. Moreover, tennis balls and the like do not mar the underlying surface and do not produce any significant noise or sound when a walker so equipped is used. These ball configuration pads or leg tips are known as "glides," due to their action in sliding over the surface and various obstacles thereon as the walker is shuffled forward during use.

However, walker glides formed of tennis balls have certain drawbacks. The primary problem with the use of tennis balls is that the napped surfaces of the balls tend to wear relatively rapidly, particularly when used outdoors upon rough surfaces such as concrete sidewalks and pavement. The resulting exposed rubber surface of the bare area of the ball acts much like a rubber crutch tip, producing a chattering effect that is difficult to control as the walker slides over the underlying surface. The wear can progress to the point that a hole is cut or worn completely through the bottom of the tennis ball, thus allowing the bottom end of the walker leg to protrude through the bottom hole and allowing the ball to ride up the leg of the walker, thereby negating the function of the ball.

Tennis ball installation cannot be readily accomplished when an existing crutch tip of larger diameter than the walker leg is installed, as the hole in the ball will not fit over the crutch tip without enlarging the hole to the extent that the ball does not remain securely affixed to the bottom of the walker leg. Thus, the relatively sharp edge of the otherwise unprotected tubular walker leg within the ball acts as a "cookie cutter" or die, tending to cut or tear out a hole in the bottom of the tennis ball. This can occur in relatively short order when the walker is used outdoors. When this occurs, the conventional solution is to remove the tennis ball and discard it, and install a new ball on the lower end of the walker leg. With at least two of the four legs requiring a ball, this clearly becomes costly in a short period of time.

Thus, a walker glide solving the aforementioned problems is desired.

SUMMARY OF THE INVENTION

The walker glide comprises various embodiments of a hollow, resilient ball having a diameter on the order of two and one-half inches, more or less, with the ball having a plurality of walker leg installation holes formed therein. Modified tennis balls have been found to work well for the purpose. None of the hole's in the ball are directly diametrically opposite one another, thus assuring that when the end of a walker leg is inserted through a hole in the ball, the tip of the leg inside the ball is in contact with the unbroken surface of the ball at that point. This assures that the outer surface of the ball, rather than the tip of the walker leg, will be in contact with the underlying surface when the walker is used.

The holes formed in the ball may be of any practicable number and may have any pattern over the surface of the ball, so long as no two holes are directly diametrically opposed to one another. The holes are preferably configured to fit closely about the diameter of the walker leg in order to grip the leg reasonably securely and to prevent the ball from inadvertently falling from the end of the leg. The holes may be formed in any shape or diameter required to fit snugly about walker legs of round, square, or other cross-sectional shape and size. Caps or plugs of matching or contrasting color and/or texture may be provided to cover the unused holes in the ball. The balls may be installed upon or applied to the lower ends or feet of innumerable legged articles in addition to walkers, e.g., chair legs, table legs, etc.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
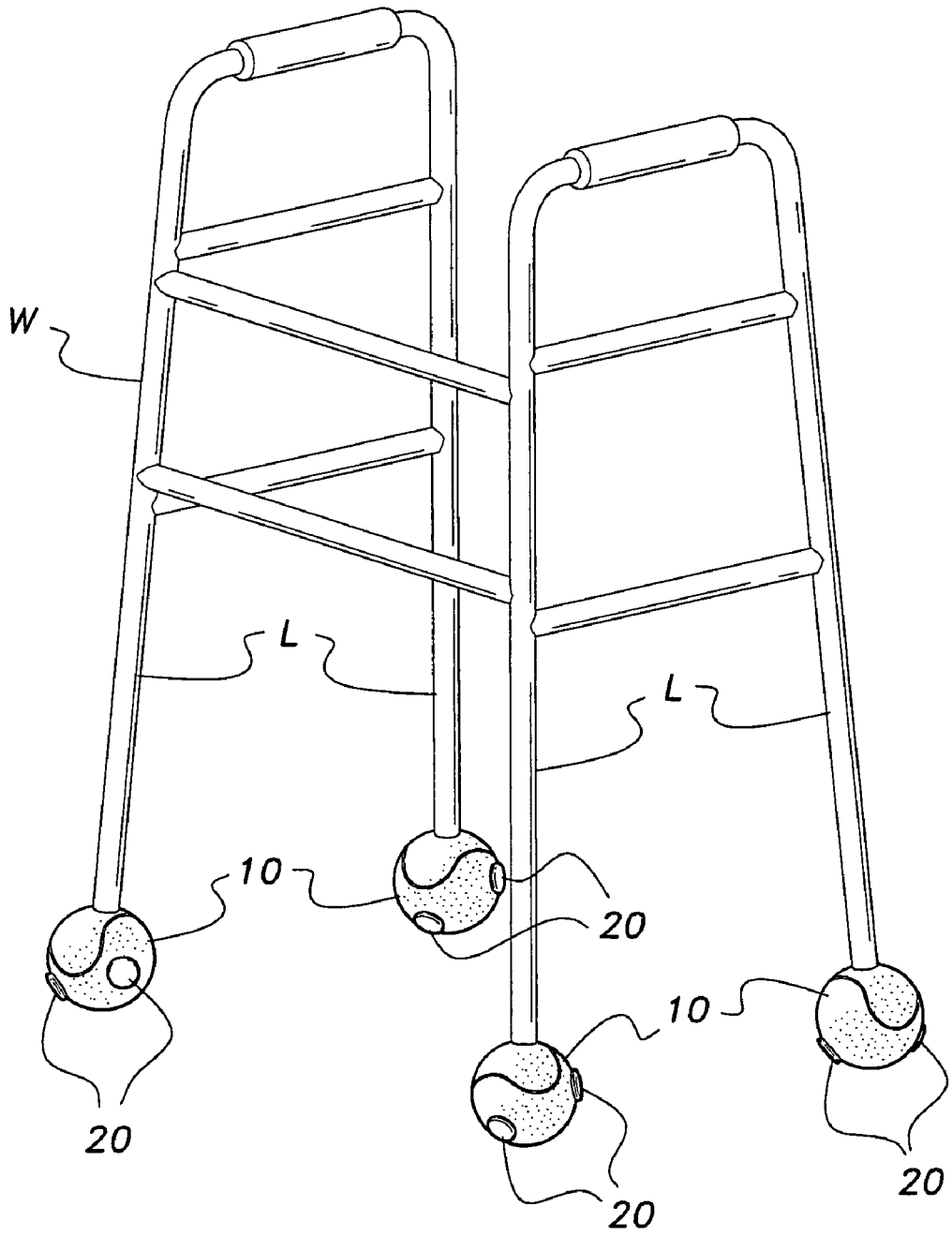
FIG. 1 is an environmental, perspective view showing a plurality of walker glides according to the present invention installed upon a walker.

The present invention comprises various embodiments of a walker glide, i.e., a device removably installed upon the lower ends of the legs of a walker as used by semi-ambulatory people. FIGS. 1 through 2B illustrate a first embodiment of the glide 10, with FIG. 1 showing four identical glides 10 installed upon the lower ends of the legs L of a walker W. While a walker W having four non-roller or non-wheeled legs is shown, it will be seen that the walker glide 10 or any of its other embodiments may be installed upon the two non-wheeled legs of walkers equipped with wheels or rollers on two of their legs.

Figure 2A:
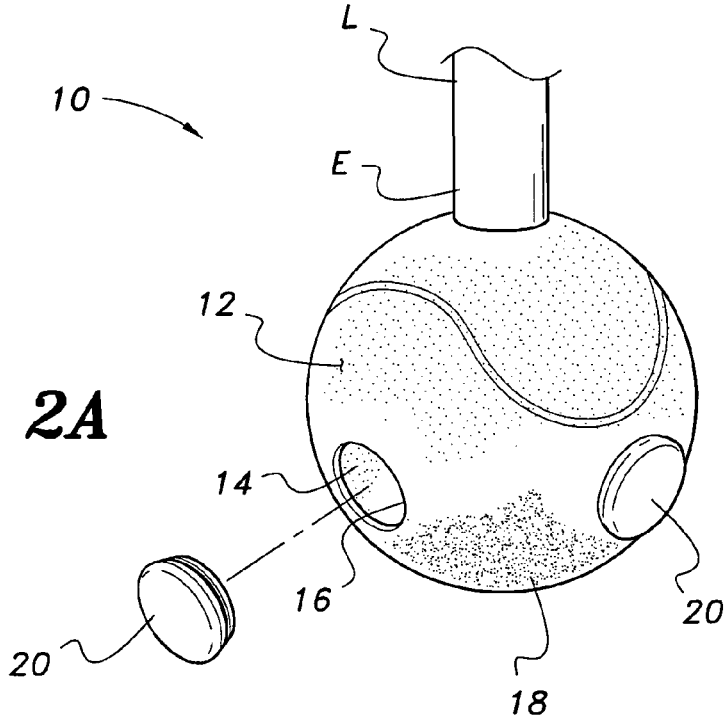
FIG. 2A is an environmental perspective view of a walker glide installed upon the lower end of a walker leg, with one of the hole caps exploded therefrom.
Figure 2B:
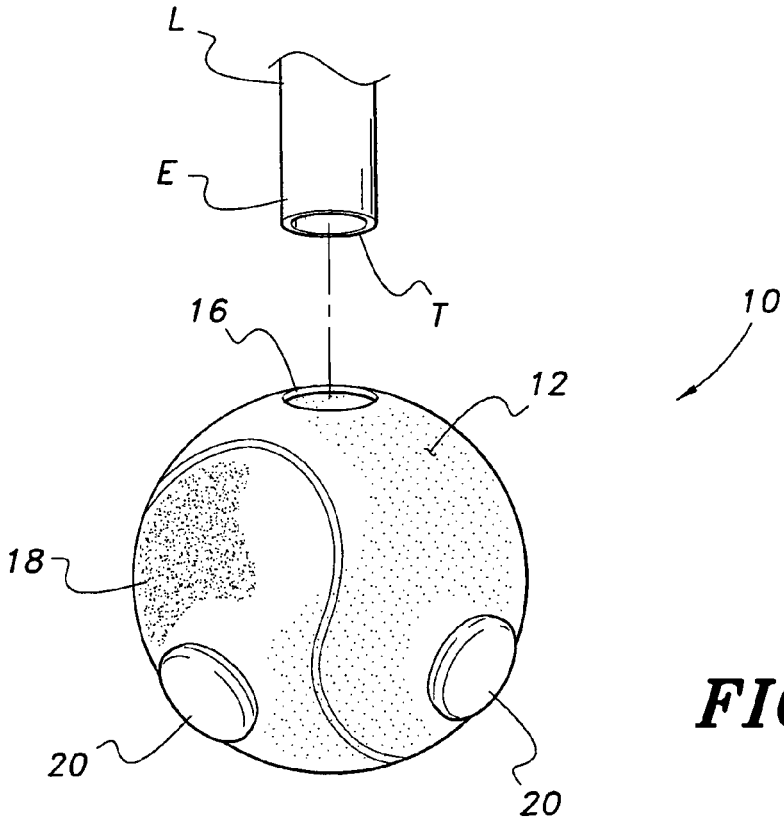
FIG. 2B is an exploded perspective view of the walker glide of FIG. 2A, shown removed from the walker leg and rotated to provide a new wear surface.

Each of the glides 10 is preferably formed from a generally spherical ball having a resilient casing 12 defining a hollow interior 14, as shown in FIGS. 2A and 2B. Tennis balls having a napped exterior surface have been found to work well, as the napped surface reduces friction to allow the walker to slide or glide over the underlying surface reasonably well when most weight is removed from the walker W, and will not mar the surface as the walker is shuffled thereacross.

FIGS. 2A and 2B provide additional details of a single walker glide 10 and its installation upon the lower end E and tip T of a walker leg L. The glide 10, or more specifically the outer casing 12, includes a plurality of walker leg attachment holes 16 formed therein. The number of holes 16 is not critical, nor is their location on or in the outer casing 12 of the glide 10, so long as no two of the holes 16 are diametrically opposite one another. As few as two such holes may be formed in the glide ball, so long as the two holes are not diametrically opposed. The asymmetric location of two such holes is not a concern, as the glide ball need not be balanced since no rotation occurs. However, most preferably more than two holes are provided M the glide ball in order to provide greater versatility and more wear points.

In the glide ball 10 of FIGS. 1 through 2B, four holes 16 are provided (with the rearward hole not being visible in the drawings), arranged in a tetrahedral pattern on the surface of the glide ball with about 120° of separation between each hole. Other hole patterns and quantities may be provided, as noted above. The provision of at least a few holes 16 allows the glide ball 10 to be removed from the end E of the walker leg L when excessive wear occurs to the area of the glide 10 diametrically opposite the leg installation hole.

In FIG. 2A, the glide 10 is installed upon the lower end E of a walker leg L by means of the uppermost of the closely fitting holes 16; the hole per se is concealed by the lower end E of the walker leg L passing therethrough and into the hollow interior 14 of the glide 10. It will be noted in FIG. 2A that the area 18 of the glide 10 directly opposite the entry of the walker leg L therein is devoid of any other holes 16, i.e., there is a solid and unbroken portion of the surface or casing 12 diametrically opposite the entry of the leg L into the glide 10. This lowermost area 18 has become worn and scuffed due to its contact with the underlying surface due to the pressure of the end E of the walker leg L bearing against the inner surface of the casing 12 during use.

FIG. 2B illustrates the glide ball 10 after being removed from the walker leg L and reoriented to reposition the worn area 18 at a location other than directly beneath the glide 10 and the walker leg L. The glide ball 10 is pulled from the leg L (the holes 16 are formed to provide a secure fit and grip the leg L to prevent slipping therefrom), and the glide ball is turned through some angle to position a second hole 16 beneath the end E of the walker leg L. The glide ball 10 is then pushed back onto the end of the leg L with the worn area 18 repositioned to a new orientation of the glide where the worn area will not bear upon the underlying surface and wear further. Instead, a fresh and unworn area is disposed beneath the glide 10, providing extended use from the glide.

The various holes 16 of the glide 10 may be covered or capped with removable covers 20 to preclude entry of debris, moisture, etc. into the hollow interior 14 of the glide 10. The covers or caps 20 may have a circumferential groove in which the edge of the hole 16 fits to hold the cover 20 resiliently in place, or other securing means as desired. Preferably, the number of caps or covers 20 provided with each glide 10 is one less than the number of holes 16 formed in the glide, as one of the holes is used for the insertion of the end E of the walker leg L at any given time.

Figure 3:
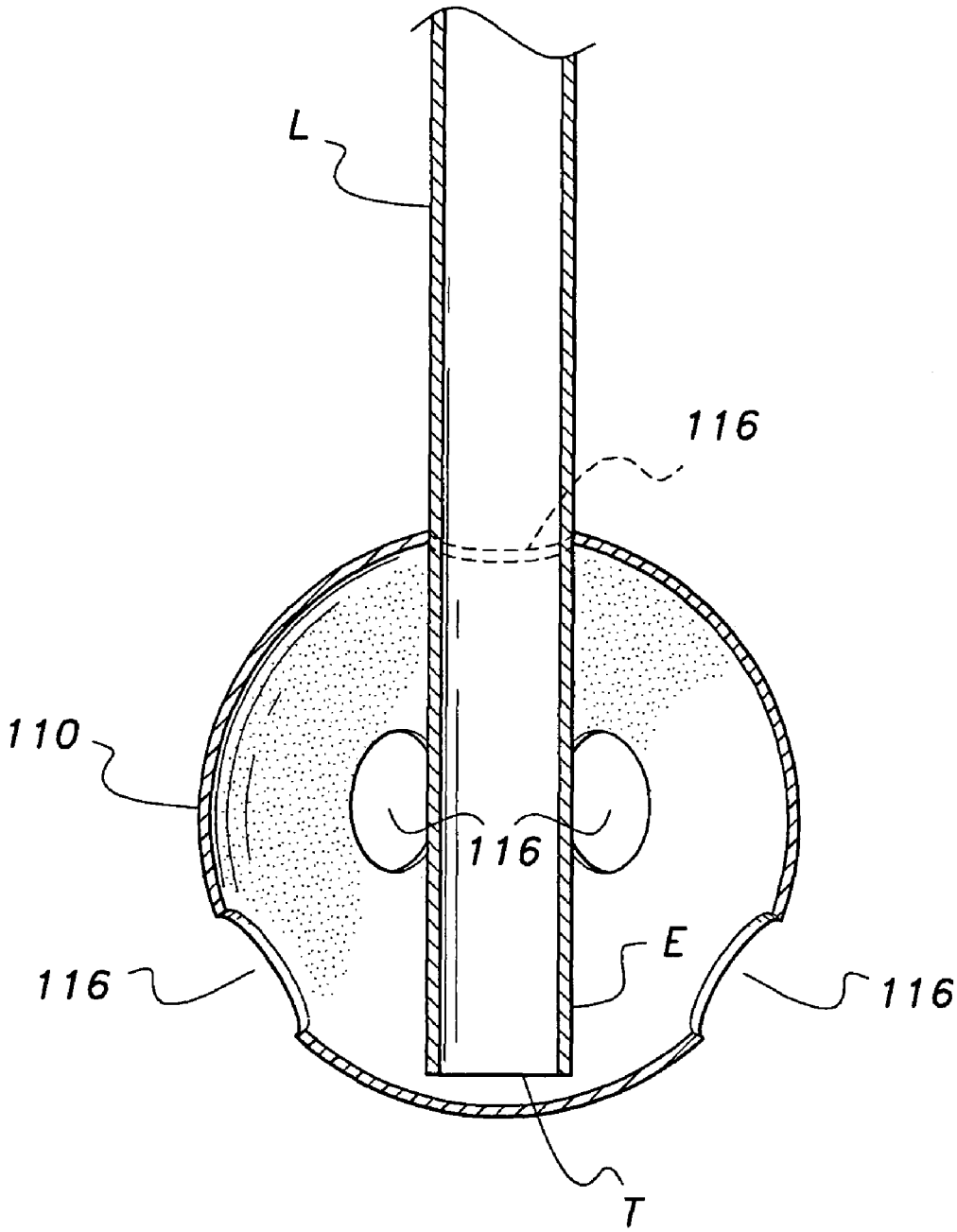
FIG. 3 is a side elevation view in section of the lower end of a walker leg with a walker glide according to the present invention installed thereon.

FIG. 3 provides an elevation view in section of an alternative glide 110. The only appreciable difference between the glide 10 of FIGS. 1 through 2B and the glide 110 of FIG. 3 is that the glide 110 has additional holes 116 formed therein. In the exemplary glide 110 of FIG. 3, it will be seen that five holes 116 are shown, albeit with two of those holes being in cross section due to their location along the section line through the glide 110. An additional hole or holes, not shown, would be provided through the hemisphere of the glide 110 that has been removed from FIG. 3. Again, the number of holes provided is not critical and may be an even or odd number, so long as no two of the holes are directly diametrically opposite one another.

Figure 4:
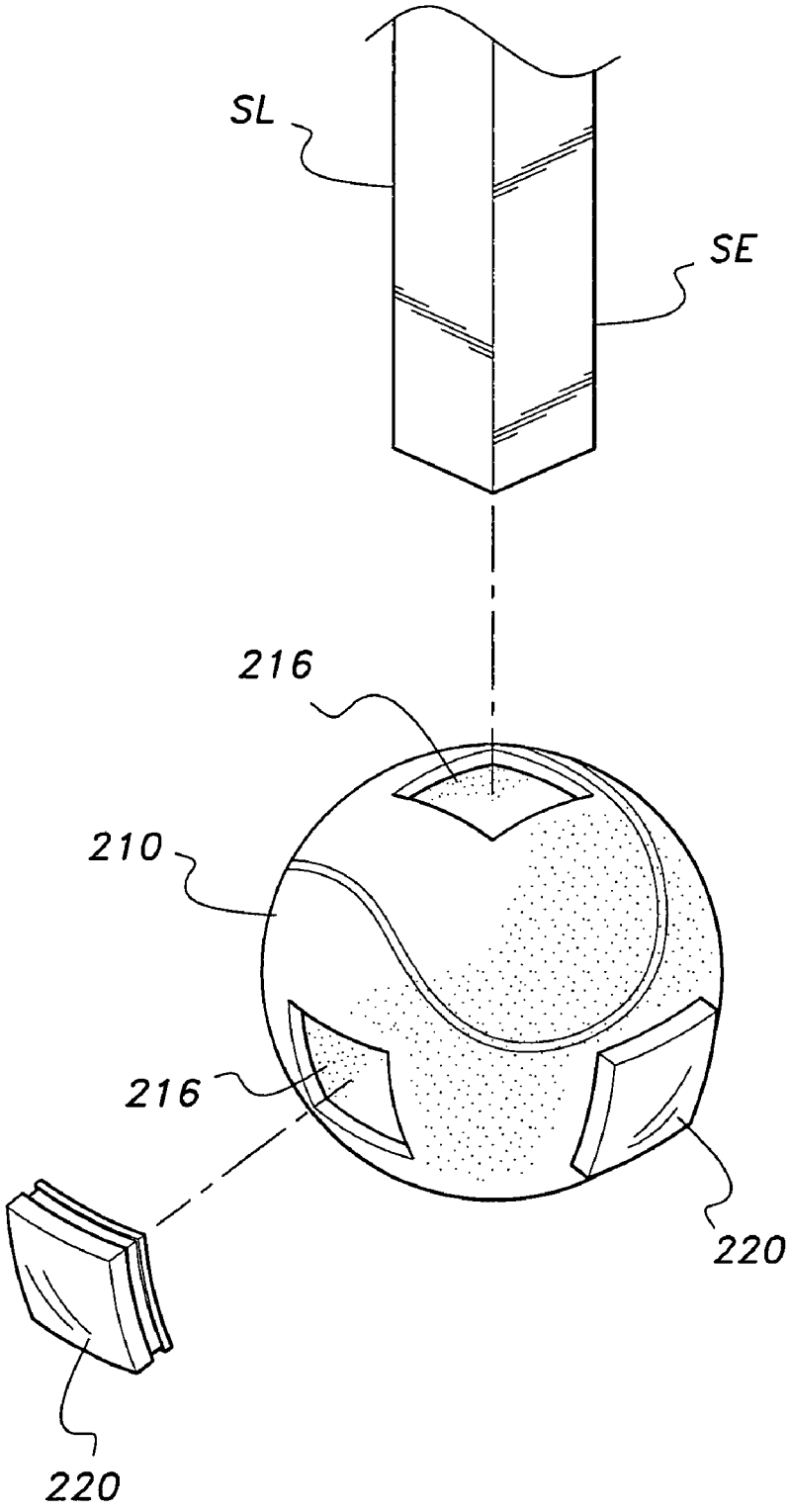
FIG. 4 is an exploded perspective view of an alternative embodiment of a walker glide according to the present invention adapted for installation upon a walker leg having a non-circular cross section.

FIGS. 1 through 3 have illustrated glides 10 and 110 having circular holes 16 and 116 in order to fit closely about walker legs L having similar cross sectional shapes. However, some walker legs may have square or other non-circular cross sections, and the holes formed in the glides may be shaped or configured accordingly. FIG. 4 illustrates such an embodiment of the walker glide, wherein the glide 210 is provided with a series of non-circular holes 216 to fit closely upon the non-circular end SE of a non-circular walker leg SL. The leg SL may have a square cross section, with the holes 216 having a closely fitting similar cross section, or the legs and holes may be of other non-circular shape or configuration, so long as the holes 216 fit closely upon the lower end SE of the leg SL. The covers or caps 220 for the holes 216 have a similar shape to that of the holes and fit closely therein to close off the interior of the glide ball 210, as in the cases of the glides 10 and 110 of FIGS. 2 through 3.

The use of the glides as applied to the lower ends of the legs of a walker has been described in detail above. However, it will be obvious to those skilled in the art that any of the embodiments of the glides may be applied to the lower ends or feet of the legs of any other legged device or article, as practicable. Examples of such articles are chairs, stools, tables, and desks, but this list is by no means exhaustive. Moreover, the glide may be installed upon the end of a pole or the like and used as a scrubber, with the napped surface serving to remove scuff marks and the like from floor surfaces. Moreover, while holes of specific configurations have been described further above, it will be obvious to those skilled in the art that the term "hole" may be construed to include slots or slits cut or otherwise formed in the ball, with the resilient material of the ball distending around the slot or slit when the ball is applied to the leg of a walker or other legged article. Thus, the glides in their various embodiments have utility considerably beyond application to the legs or feet of a walker.

It is to be understood that the present invention is not limited to the embodiments described above, but encompasses any and all embodiments within the scope of the following claims.

I claim:

1. A glide, comprising:

a ball having a resilient casing defining a hollow interior, the casing having a plurality of leg attachment holes formed therein, each of the holes has a solid and unbroken portion of the casing disposed directly and diametrically opposite the hole, wherein the remainder of the casing defines a substantially imperforate surface; and a plurality of covers removably installed across a corresponding one of the holes of the ball.

2. The glide according to claim 1, further comprising:

a walker having a plurality of non-wheeled legs, each of the non-wheeled legs having a lower end and a tip; and a plurality of balls corresponding in number to the number of non-wheeled legs of the walker, each of the balls being installed removably over the lower end and tip of a corresponding one of the non-wheeled legs of the walker.

3. The glide according to claim 2, wherein:

each of the non-wheeled legs of the walker is circular in cross section; and each of the holes in the balls are circular, fitting closely about the non-wheeled legs of the walker.

4. The glide according to claim 2, wherein:

each of the non-wheeled legs of the walker is non-circular in cross section; and each of the holes in the balls is non-circular, fitting closely about the non-wheeled legs of the walker.

5. The glide according to claim 2, wherein the balls are formed from tennis balls.

6. The glide according to claim 1, wherein each of the holes is circular.

7. The glide according to claim 1, wherein each of the holes is square.

8. The glide according to claim 1, wherein the ball is formed from a tennis ball.

9. The glide according to claim 1, wherein there are three holes formed in the casing.

* * * * *